US005709186A

United States Patent [19]

Taue

[11] Patent Number: 5,709,186

[45] Date of Patent: Jan. 20, 1998

[54] LUBRICATION DEVICE FOR CRANK CHAMBER SUPERCHARGED ENGINE

[75] Inventor: Jun Taue, Iwata, Japan

[73] Assignee: Yamaha Hatsudoki Kabushiki Kaisha, Iwata, Japan

[21] Appl. No.: 563,971

[22] Filed: Nov. 29, 1995

[51] Int. Cl.[6] ..... F01M 3/00

[52] U.S. Cl. ..... 123/196 W; 184/6.8; 184/6.18

[58] Field of Search ..... 123/196 W, 196 R, 123/196 CP, 196 M; 184/6.8, 6.18

[56] References Cited

U.S. PATENT DOCUMENTS

| | | | |
|---|---|---|---|
| 4,392,463 | 7/1983 | Yasuhara | 123/196 M |
| 4,599,979 | 7/1986 | Breckenfeld et al. | 123/73 AD |
| 4,700,671 | 10/1987 | Matsushita . | |
| 5,052,355 | 10/1991 | Ito et al. | 123/196 R |
| 5,195,474 | 3/1993 | Urata et al. | 123/196 R |
| 5,375,573 | 12/1994 | Bowman | 123/196 R |
| 5,377,634 | 1/1995 | Taue . | |
| 5,396,867 | 3/1995 | Ito et al. | 123/196 R |
| 5,511,523 | 4/1996 | Masuda | 123/196 R |
| 5,513,608 | 5/1996 | Takashima et al. | 123/196 W |

FOREIGN PATENT DOCUMENTS

| | | |
|---|---|---|
| 0376130 | 7/1990 | European Pat. Off. . |
| 0503635 | 9/1992 | European Pat. Off. . |
| 2605677 | 4/1988 | France . |

*Primary Examiner*—Erick R. Solis

*Attorney, Agent, or Firm*—Knobbe, Martens, Olson & Bear LLP

[57] ABSTRACT

A crankcase compression four-cycle internal combustion engine having a valve actuating mechanism that is lubricated by first four-cycle type lubricating system. A second two-cycle lubricating system is provided for lubricating the crankcase and components associated therewith. The second lubricating system also delivers lubricant to the piston and piston pin through a groove passage way formed in part in the connecting rod for their lubrication.

24 Claims, 6 Drawing Sheets

LUBRICATION DEVICE FOR CRANK CHAMBER SUPERCHARGED ENGINE

BACKGROUND OF THE INVENTION

This invention relates to a crank chamber supercharged engine and more particularly to an improved lubrication system for such engines.

Although it has been the practice with many types of two-cycle engines to employ the variation in effective volume of the crankcase chamber during the reciprocation of the piston as a device for compressing the intake charge, this concept can also be employed in conjunction with four-cycle engines. However, in order to obtain effective compression, it is necessary to ensure that the clearance volume of the crankcase chamber is kept as small as possible. By doing this and, since the crankcase chamber undergoes two compression cycles for a given firing of the combustion chamber with a four-cycle engine, a significant supercharging effect can be achieved utilizing such a concept.

A very effective mechanism for achieving this result is disclosed in my U.S. Pat. No. 5,377,634, entitled "Compressor System For Reciprocating Machine," issued Jan. 3, 1995 and assigned to the assignee hereof.

With mechanisms of this type, it has been the practice to lubricate the entire engine primarily in the same manner as with a two-cycle engine. That is, since the crankcase chamber is in effect not sealed, but rather acts as a pump, it cannot be employed to retain any significant amounts of lubricant. Therefore, systems have been proposed where a lubricant is delivered to the engine through the intake charge or through the induction system.

These systems, however, are more closely geared to the simpler two-cycle engine and may not afford adequate lubrication for the components of a four-cycle engine. This is particularly true with respect to the valve mechanism and valve operating system for such engines. In addition, the addition of lubricate to the intake charge can cause smoke to appear in the exhaust and will render exhaust emission control difficult.

It is, therefore, a principal object of this invention to provide an improved lubricating system for an engine having a crankcase compression arrangement and operating on a four-cycle principle.

It is a further object of this invention to provide an improved lubricating system for a crankcase compression four-cycle internal combustion engine.

In conjunction with the engine lubrication, the sliding surfaces of the piston and the cylinder bore require lubrication as does the pivotal connection between the piston and the connecting rod which is normally via a piston pin. In conventional two-cycle engines, this lubrication may be achieved by mixing lubricant with the fuel or by introducing fuel into the induction system for the engine. However, these highly stressed areas may not always receive the adequate and proper amounts of lubricant under these conditions.

Therefore, arrangements have been provided for supplying lubricant directly to the cylinder bore and the sliding surface of the piston through ports located in the cylinder wall. Although these systems are effective, they still fail to provide adequate lubrication for the piston pin journal and may not provide optimum lubricant for the external surface of the piston. These problems are particularly acute when the engine is operated in such a way that the piston reciprocates along a horizontal axis. It is, therefore, a still further object of this invention to provide an improved arrangement for lubricating a piston and connecting rod connection in a reciprocating machine.

It is a further object of this invention to provide an improved arrangement for lubricating a horizontally operating piston and its pivotal connection to a connecting rod.

SUMMARY OF THE INVENTION

This invention is adapted to be embodied in an internal combustion engine that is comprised of a cylinder block cylinder head assembly that defines a cylinder bore. A piston reciprocates in the cylinder bore and forms a combustion chamber at one end of the cylinder bore. A crankcase chamber is formed at the other end of the cylinder bore and contains a rotatably journaled crankshaft. The piston is connected to the crankshaft by a connecting rod so as to effect rotation of the crankshaft upon reciprocation of the piston. The crankshaft, connecting rod, piston and crankcase chamber are formed so that the crankcase chamber functions as a compressor as the piston reciprocates in the cylinder bore. An induction system including the crankcase chamber is provided for delivering atmospheric air to the crankcase chamber for compression and from the crankcase chamber to the combustion chamber through at least one reciprocally supported poppet type valve that cyclically opens and closes the communication of the intake passage with the combustion chamber. A valve operating mechanism is associated with the poppet valve for operating the valve and timed relationship to the rotation of the crankshaft. A first lubricating system that supplies a two-cycle type lubricant supplies lubricant to the crankcase chamber for lubrication of the components contained therein. This system includes a lubricant source and an arrangement for supplying lubricant from the source to the crankcase chamber. A second lubricating system including a second source of lubricant of the type normally employed with four-cycle engines is provided for supplying lubricant to the valve operation mechanism. Lubricant is returned from the valve operating mechanism back to a reservoir for this second source of lubricant through a return passage.

Another feature of this invention is adapted to be embodied in a system for lubricating a piston that is slidably supported in a cylinder bore. The piston has a pivotal connection through a piston pin to one end of the connecting rod. In accordance with this feature of the invention, the piston is provided with a pair of transversely extending lubricant receiving recesses disposed on diametrically opposite side of the piston and in relation to the cylinder bore on diametrically opposite sides. One side of the connecting rod is provided with a lubricant receiving channel that extends from a point below the skirt of the piston to an area contiguous to the piston pin. Means communicate the ends of this groove with the piston pin and one of the piston recesses. Means supply lubricant to the cylinder bore through an outer surface thereof which is in registry with the connecting rod groove under some positions of the piston and with the remaining piston recess in other operative positions of the piston.

DETAILED DESCRIPTION OF THE PREFERRED EMBODIMENTS OF THE INVENTION

Figure 1:
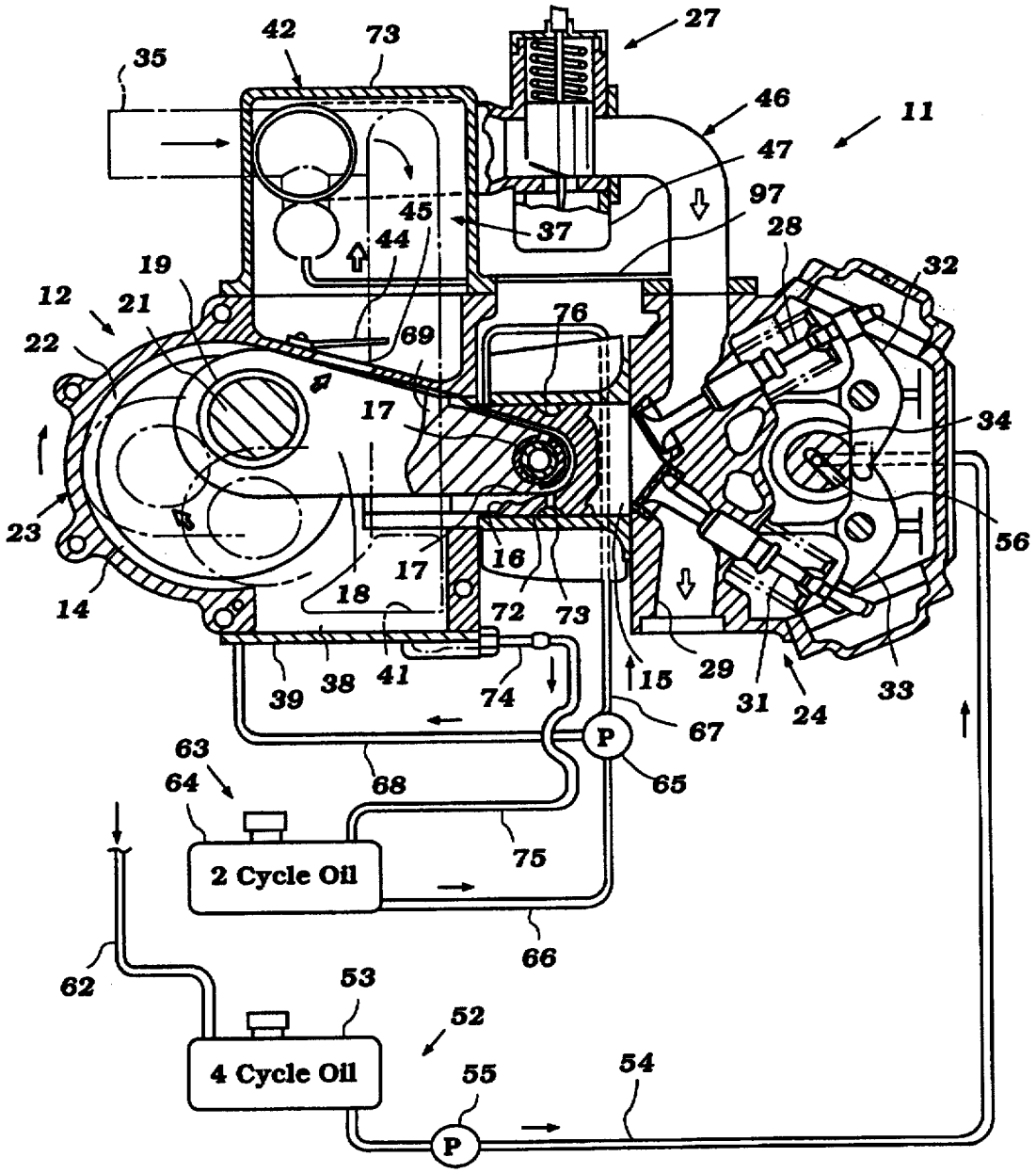
FIG. 1 is a partially schematic cross-sectional view taken through one cylinder of an internal combustion engine constructed in accordance with an embodiment of the invention.

Referring now in detail to the drawings and initially to FIG. 1 a four cycle internal combustion engine constructed in accordance with an embodiment of the invention is identified generally by the reference numeral 11. The engine 11 may be of any known configuration such as an in-line engine, a V-type engine or an opposed engine and may have any number of cylinders. Since the invention may be employed with multiple cylinder engines having any of these types of configurations, only a single cylinder of the engine 11 has been illustrated.

Also, although the invention is described in conjunction with a four cycle internal combustion engine, it is to be understood that facets of the invention may be employed with engines operating on other principles such as two stroke engines.

The engine 11 is provided with a cylinder block crankcase assembly, indicated generally by the reference numeral 12 and composed of a cylinder block 13 and a crankcase member 14 that are fixed to each other in any suitable manner or which may be formed as a unitary assembly if desired. The cylinder block 13 is provided with one or more cylinder bores 15 in which pistons 16 reciprocate and which extend horizontally as shown in the drawings. Each piston 16 is pivotally connected by means of a piston pin 17 to the small end of a connecting rod 18.

The big end of the connecting rod 18 is journaled on the throw or crank pin 19 of a crankshaft, indicated generally by the reference numeral 21 which is rotatably journaled within a crankcase chamber 22 which, in turn, is formed in the crankcase member 23. If the engine 11 is of a multi-cylinder type, each crankcase chamber 22 will be preferably sealed from the others.

A cylinder head assembly, indicated generally by the reference numeral 24 is affixed to the cylinder block 13 in any well known manner. The cylinder head 24 has a recess 25 formed in its lower surface which recess align with the cylinder bore 15 and the head of the piston 16 to form the individual combustion chambers of the engine 11. The recesses 25 will, at times, be referred to as the combustion chambers since at top dead center (TDC) their volume comprises the major portion of the clearance volume.

An intake passage 26 extends through one side of the cylinder head 24 and is served by an induction and charge forming system, indicated generally by the reference numeral 27 and which will be described in more detail later. The intake passage 26 terminates at its inner side at a valve seat which is controlled by an intake valve 28.

In a similar manner, an exhaust passage 29 extends through the opposite side of the cylinder head 24 and terminates in a valve seat that is controlled by an exhaust valve 31. In the illustrated embodiment, the intake and exhaust valves, 28 and 31 respectively, are operated by respective rocker arms 32 and 33 which, in turn, are controlled by a single overhead camshaft 34 that is journaled for rotation in the cylinder head 24 in a known manner. The camshaft 34 is driven from the crankshaft 21 by a drive mechanism at one half crankshaft speed, as is well known in this art.

The valve springs keeper mechanisms etc. associated with the intake and exhaust valves 28 and 31 may be of any conventional construction and those skilled in the art will readily understand the valve actuation and how this can be accomplished.

An important feature of this invention is the way in which the crankcase chamber 22, connecting rod 18 and crankshaft 21 are configured so as to cooperate with the piston 16 and act as a positive displacement air compressor or supercharger supplying a pressurized air/fuel mixture to the combustion chamber 25. To this end, the construction of the cylinder block crankcase assembly 22, crankshaft 21, connecting rods 18 and piston 16 which permits this positive displacement compressor is constructed in accordance with the manner described in U.S. Pat. No. 5,377,634, entitled "Compressor System For Reciprocating Machine," issued Jan. 3, 1995 and assigned to the assignee hereof. That disclosure is incorporated herein by reference. In this system the air/fuel mixture is drawn into the induction system 27 through an atmospheric air inlet 35 which draws air through any type of inlet device which may include a silencer and/or filter. This charge is drawn by the negative pressure created in the crankcase chamber 22 by the reciprocating motion of the piston 16. The construction of the piston 16, connecting rod 18, crankshaft 21 and crankcase chamber 22, as noted in the aforenoted incorporated Patent, is such that they define an enclosed volume inside crankcase chamber 22 into which the air/fuel charge is drawn by the upward motion of piston 16.

Referring now in more detail to the charge forming system 27, the air inlet device 35 delivers the inducted atmospheric air to an intake pipe or manifold 37. The intake manifold in turn delivers the air to an inlet chamber 38 formed on the lower side of the cylinder block 13 and crankcase member 23. This chamber 38 is closed by a cover plate 39. The inlet chamber 38 communicates with the crankcase chamber 22 to which it supplies the uncompressed air through an intake port 41. As noted in the aforenoted Patent, the intake port 41 is opened and closed by the connecting rod 18 during its movement.

As the piston 16, connecting rod 18 and crankshaft 21 continue their movement, the inducted charge will continue to be drawn into the crankcase chamber 22 until the connecting rod 18 again closes the intake port 41. Thereafter the inducted charge will be compressed in the closed chamber into which the crankcase chamber 22 is formed on one side of the connecting rod 18. This compressed charge is then delivered to a plenum chamber 42 in a manner to be described shortly.

The plenum chamber 42 is formed by a housing element 43 that sealingly engages crankcase chamber 22 on its upper side, opposite the intake port 41 to the crankcase chamber 22. The plenum chamber 42 receives a supply of compressed air/fuel mixture from the crankcase chamber 22 through a reed valve 44. The reed valve 44 controls the flow through an opening 45 formed in an upper wall of the crankcase member 22 and permits the charge only to exit.

A pressure air conduit 46 delivers the compressed air charge from the plenum chamber 42 to the cylinder head intake passage 26. A conventional piston throttle type carburetor 47 is provided in the pressure air conduit for forming the fuel air charge delivered to the intake passage 26.

The lubrication system for the crank chamber supercharged engine 11 will now be described. A conventional four cycle lubrication system is inappropriate for this type of engine as one of the requirements for a four stroke crankcase compression type engine is that the crankcase chamber 22 must be of minimum possible volume in order to obtain effective air/fuel charge compression and also because all of the intake charge passes through the crankcase chamber 22.

This is incompatible with the standard four cycle practice of utilizing the crankcase chamber 22 as the oil storage reservoir for the engine 11. However the valve train including the valves 28 and 31, the rocker arms 32 and 33, the cam shaft 34 and their bearings and guides require adequate lubrication. Therefore the engine 11 utilizes a lubricating system which utilizes two oil delivery systems: one of which supplies four cycle oil to the various components of the cylinder head 24 and timing case and a second which supplies two cycle oil to the various components of the cylinder block 13.

Figure 2:
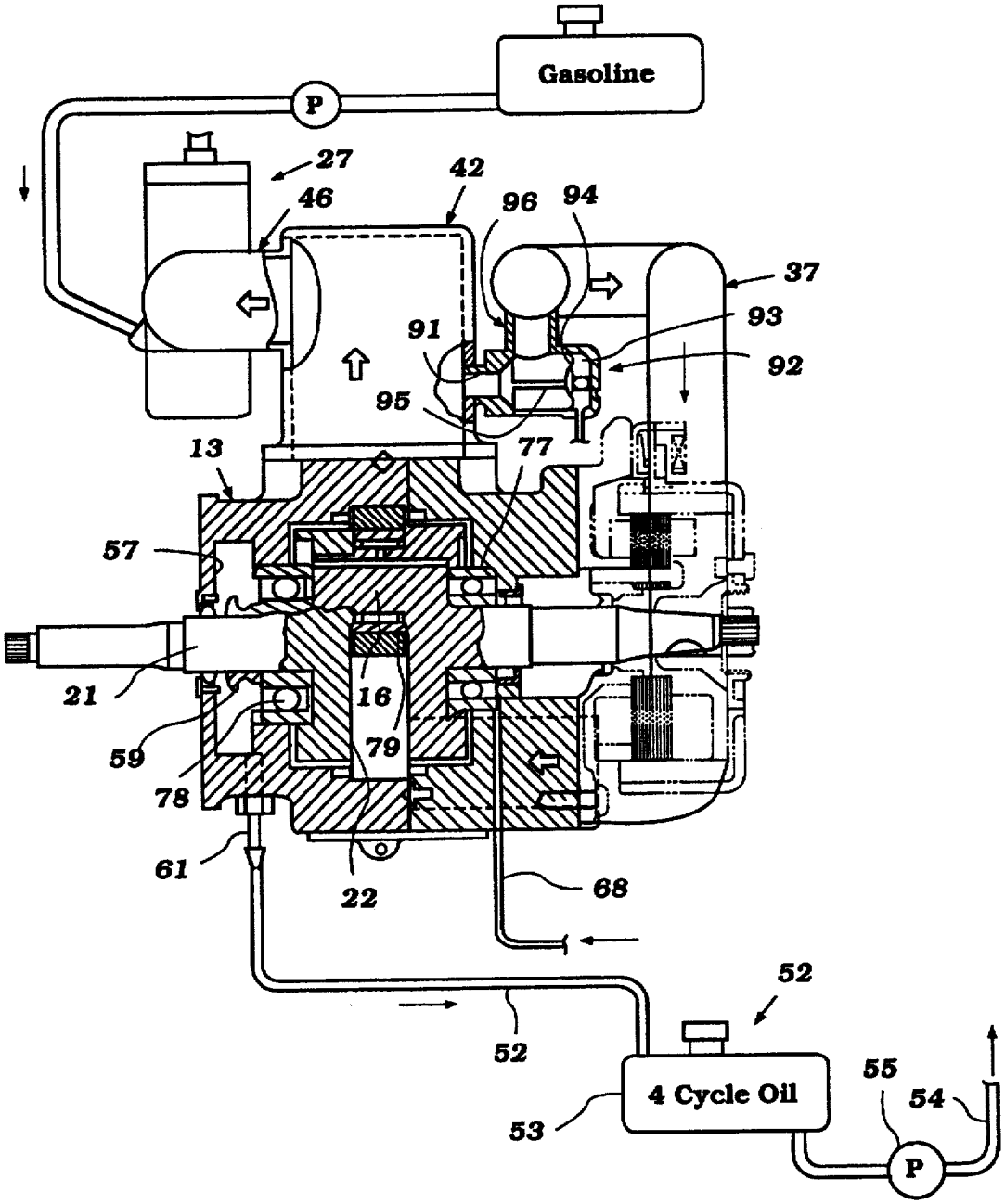
FIG. 2 is an enlarged cross-sectional view taken along the line 2—2 of FIG. 1.
Figure 3:
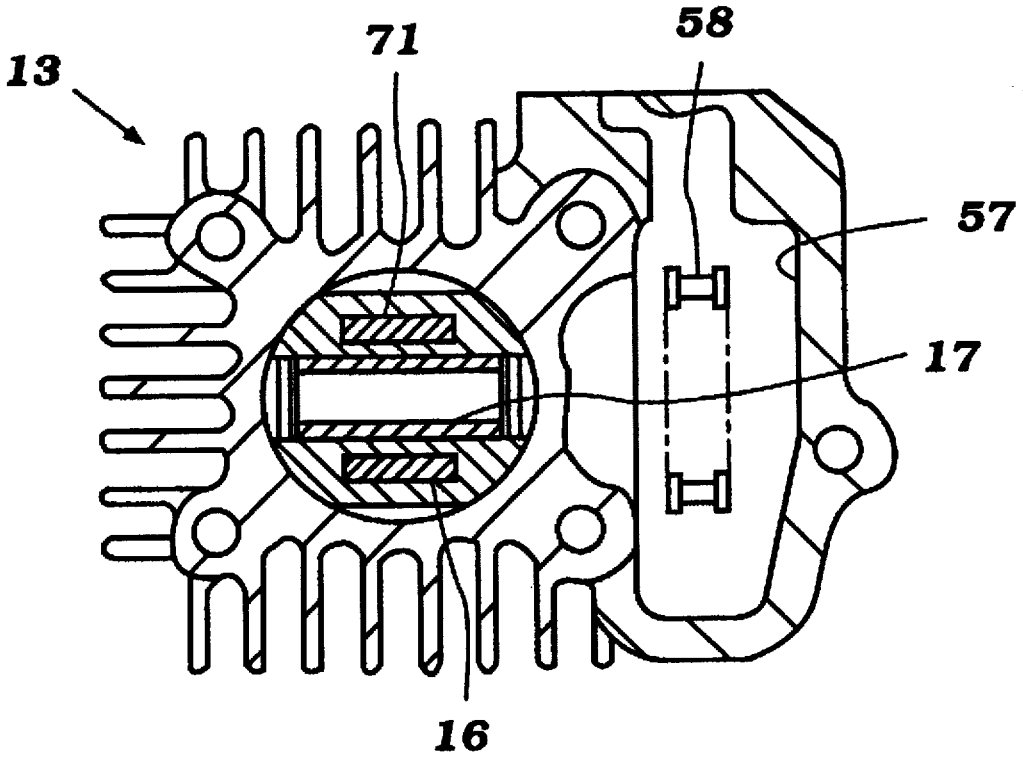
FIG. 3 is a cross-sectional view taken along the line 3—3 of FIG. 1 and shows the connection of the piston to the connecting rod.

Referring to the four cycle oil delivery system, this is best shown in FIGS. 1 and 2 and is identified generally by the reference numeral 52. Oil for this system is supplied from a four cycle oil tank 53 which contains the type of oil utilized normally with four cycle engines. This oil is supplied to the camshaft 34 at its main bearing (not shown) through conduit 54 in which is positioned an oil pump 55. The pump 55 is driven in any suitable manner. The camshaft 34 is drilled to provide a main oil gallery. Oil is delivered into camshaft 34 through a cross drilled camshaft oil inlet 56. Oil is delivered from the main gallery to the camshaft bearings (not shown) and rocker arm assemblies 32 and 33 respectively though oil feed holes drilled in the camshaft 34. Thus it is readily apparent that all of the components of the valve actuating mechanism are effectively lubricated by the four cycle oil which subsequently collects along a lubricating return path (not shown).

This return path routs the oil to a timing case 57 where it lubricates the components of the camshaft timing drive mechanism such as a chain 58 and the camshaft sprocket (not shown) and the crankshaft sprocket 59 before draining out of timing case 57 at one end of the crankshaft 21 through exit nipple 61. The exit nipple 61 supplies a four cycle oil return conduit 62 which, in turn, returns to the four cycle oil reservoir 53.

Figure 5:
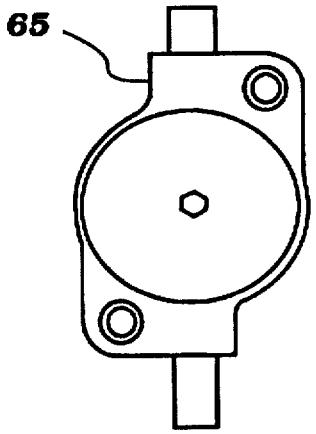
FIG. 5 is an end elevational view of the flow control pump for the two-cycle type lubricating system.
Figure 6:
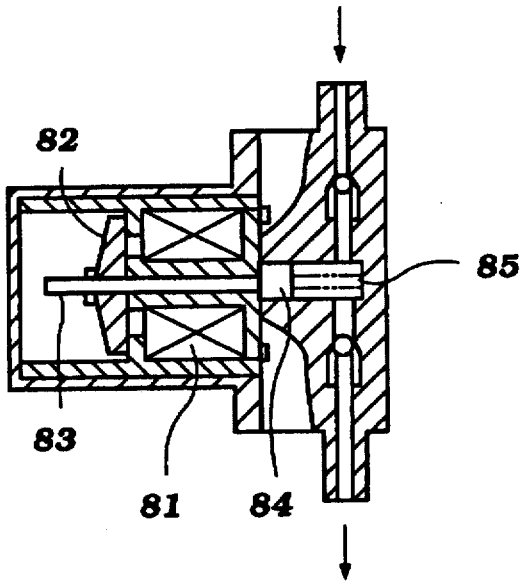
FIG. 6 is a longitudinal cross-sectional view of the flow control pump.

Referring now to the two cycle oil delivery system, indicated generally by the reference numeral 63, also shown primarily in FIGS. 1 and 2, it includes a two cycle oil tank 64. The oil tank 64 holds a supply of oil of the type normally used for two cycle engine lubrication. A metering type oil pump 65 having a construction as shown in FIGS. 5 and 6 pumps two cycle oil from the two cycle oil tank 64 through a conduit 66 to the ends of the engine block assembly 13, as seen on FIG. 1, via branch conduits 67 and 68 respectively. The pump 65 will be described in more detail later.

Figure 4:
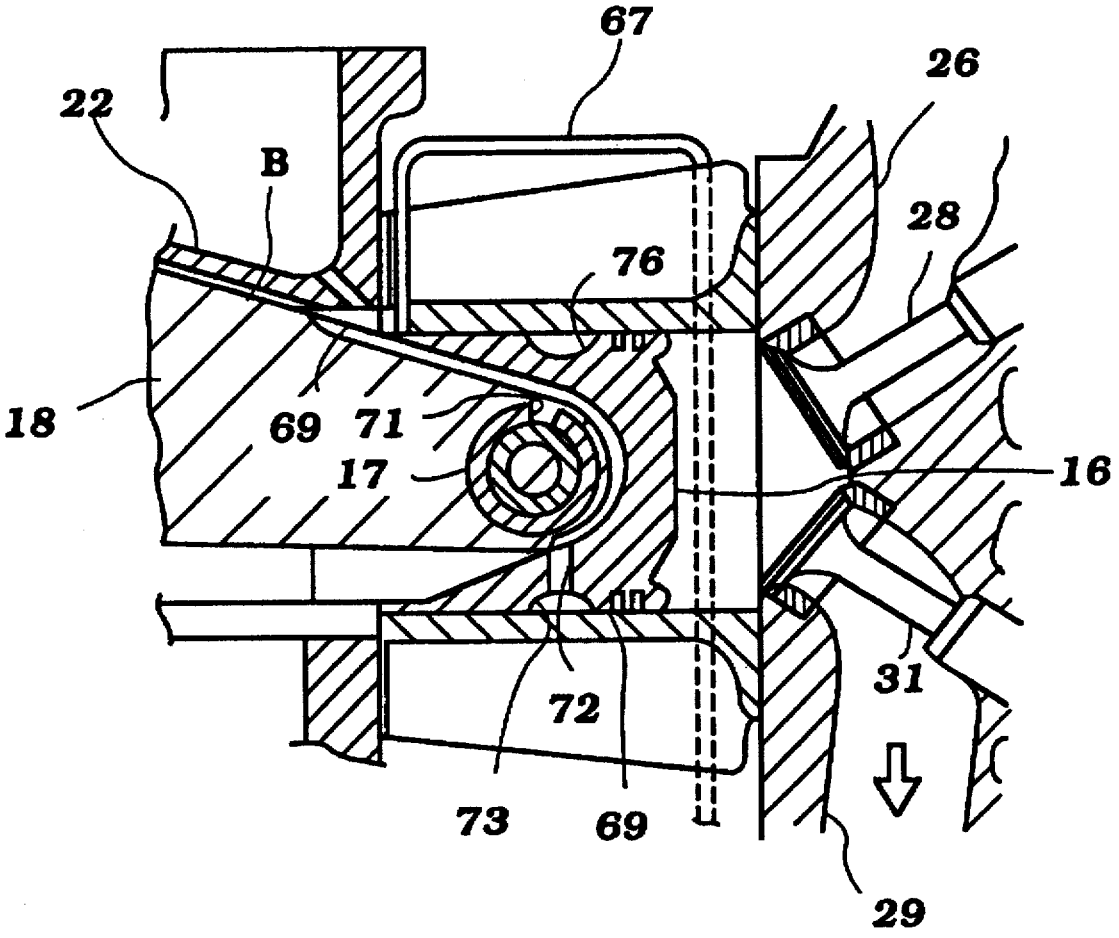
FIG. 4 is an enlarged cross-sectional view taken along a plane perpendicular to the plane of FIG. 3 and also showing the piston, connecting rod connection and the lubricating arrangement therefor.

Conduit 67 supplies oil to the cylinder bore 15 at a location that is exposed to the crankcase chamber 22 when the piston 16 is approaching top dead center. This oil is fed into groove 69 (see also FIG. 4)cut along the exterior side of the connecting rod 18. When conduit 67 is thus exposed, the connecting rod 18 is positioned as shown in FIGS. 1 and 4. The lubricant will collect in the groove and as the piston 16 reverses direction and moves toward bottom dead center the oil will be pumped along groove 69 to lubricate the piston's lower surface as well as the upper end of the connecting rod 18. This action will also cause the oil to enter the piston pin assembly 17 through inlet slot 71, there to lubricate the surface of piston pin 17.

The connecting rod groove 69 extends around the upper end of the connecting rod 18 to a point where it is then routed through a piston oil slot 72 to a recess 73 formed on the lower portion of the piston 16 and finally on to the cylinder wall. Any remaining oil will drain to the crankcase chamber 22 and specifically to the inlet chamber 38. From there the oil will drain through a two cycle drain nipple 74. The oil drains into a two cycle oil return conduit 75 which, in turn, connects at its lower end to the two cycle oil reservoir 64.

As the piston 16 reciprocates downwards upon initiation of an engine inlet or power stroke the supply of two cycle oil to the crankcase chamber 22 from conduit 67 will be restricted to lubricate only the skirt of the piston 16. However, continued downward motion of piston 16 exposes the outlet for conduit 67 to an upper side piston recess 76 in which the oil will collect and lubricate the outer circumferential surface of piston 16 until it too is collected at the inlet nipple of the two cycle oil return conduit 74.

Conduit 68 supplies two cycle lubricating oil to the engine's big end. As can be best seen in FIG. 2 oil is delivered by the conduit 68 to one main bearing 77 of the crankshaft 21. The crankshaft 21 is cross drilled enabling the oil supplied at crankshaft bearing 77 to not only lubricate this bearing 77 but also to circulate through crankshaft 21 to its other main bearing 78 which journals crankshaft 21 to crankcase chamber 22. Through these cross drillings lubricant is also delivered to a bearing 79 that journals the connecting rod 18 to the crank throw 19. Thus, all of the crankshaft bearings in crankcase chamber 22 are adequately lubricated by the two cycle oil before it collects in the air inlet 38 of the crankcase 22 for delivery to the two cycle oil return conduit 75 which, in turn, connects at its lower end to two cycle oil reservoir 64.

The oil metering pump 65 has a construction as best shown in FIGS. 5 and 6. This pump is comprised of an electrical solenoid winding 81 that actuates an armature 82 that is affixed to a pumping element 83 which, in turn, has a piston portion 84. The piston portion 84 is reciprocated upon selective actuation of the solenoid winding 81 so as to urge the pump in a pumping direction in opposition to a return spring 85. When the pump 65 is in the full pumping position as shown in this figure, oil that has been drawn from the oil tank through a one-way check valve will be compressed and forced past another opposite acting one-way check valve into the conduits 67 and/or 68. By controlling the frequency of the pumping, then the amount of lubricant supplied can be controlled so that the engine will only receive such lubricant as required for its adequate lubrication. If desired, a separate pump may be provided for each of the conduits 67 and 68 so as to provide more accurate control.

Under some circumstances it may be desirable to control the maximum pressure of the charge delivered to the combustion chamber 25, as would be the case during engine deceleration A venting or pressure relief mechanism is disposed in the charge forming system 27 to accomplish this. As can be best seen in FIG. 2 an air vent hose 91 extends between the plenum chamber 42 and the air inlet pipe 37. The flow through this hose 91 is controlled by a spring loaded popper type valve 92. The valve spring 93 engages a diaphragm 94 to which a valve element 95 is fixed. The spring 93 has sufficient preload to cause the valve element 95 to sealingly engage air vent inlet hose 91 until such time as when the pressure of the charge in the plenum chamber 42 is sufficiently high to displace the valve 92 rearward, thereby allowing the pressurized charge to vent back to the atmospheric air inlet 37 through a vent air outlet hose 96.

If desired the chamber in which the spring 93 is located may also be connected by a conduit 87 to the intake manifold 46 downstream of the carburetor 47. When this is done, under extreme decelerations the high intake manifold vacuum will overcome the bias of the spring 93 and cause the valve element 95 to open and relieve the high pressure in the plenum chamber 42.

Figure 7:
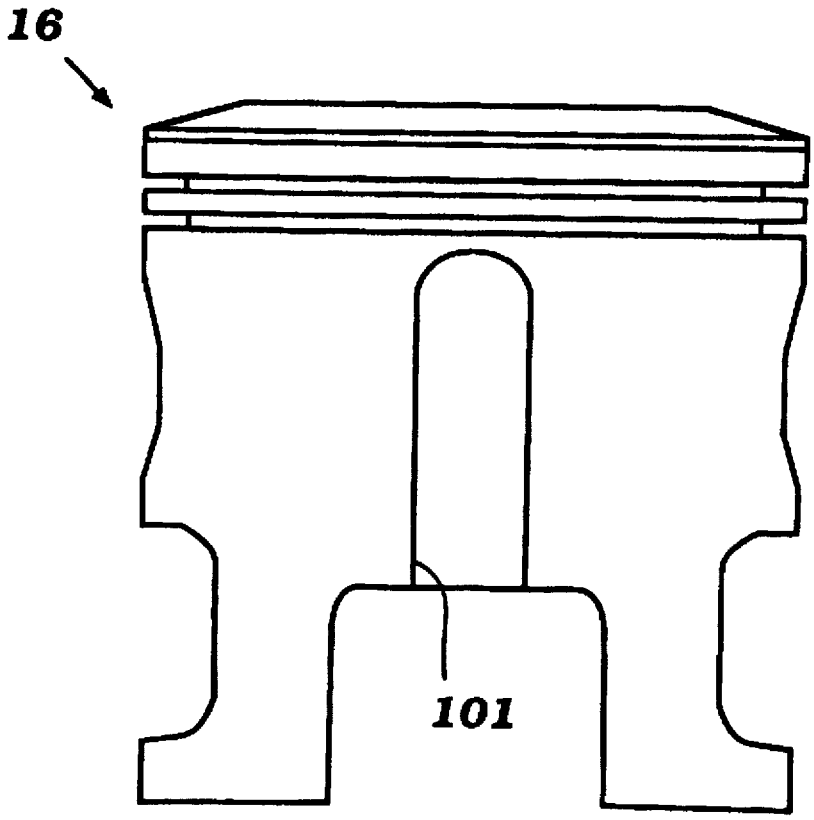
FIG. 7 is a side elevational view of another embodiment of piston and shows its lubricating arrangements.

In the embodiment as thus far described, lubricant has been supplied to the upper and lower recesses of the piston by indirect and direct methods. Some of this lubricant supply is not continuous. Therefore, it may be possible to provide a lubricant supply to the exterior of the piston through a longitudinally extending slot 101 as shown in FIG. 7. With this arrangement, lubricant will also be supplied continuously during the stroke of the piston.

It should be readily apparent form the foregoing description that the described engine has a very effective lubricating system wherein certain of the components and particularly those in direct contact with the combustion chamber are lubricated by a recirculating type lubricating system. Other components which has less direct contact with the combustion chamber are lubricated by a nonrecirculating lubrication system, but wherein any collective lubricant can be returned to the supply tank for this system. In addition, an improved arrangement for lubricating the exterior surfaces of the piston and its connection to the connecting rod are disclosed.

Of course, the foregoing description is that of preferred embodiments of the invention and various changes and modifications may be made without departing from the spirit and scope of the invention, as defined by the appended claims.

What is claimed is:

1. An internal combustion engine comprised of a cylinder block, cylinder head assembly defining a cylinder bore, a piston reciprocating in said cylinder bore and forming a combustion chamber at one end of said cylinder bore, a crankcase chamber formed at the other end of said cylinder bore and containing a rotatably journaled crankshaft, a connecting rod for connecting said piston to said crankshaft for driving said crankshaft upon reciprocation of said piston, said connecting rod, said piston and said crankcase chamber being formed so that said crankcase chamber functions as a compressor as said piston reciprocates in said cylinder bore, said crankcase chamber forming a portion of an induction system for delivering atmospheric air under pressure to said combustion chamber, said induction system comprising in addition to said crankcase chamber an atmospheric air inlet for supplying atmospheric air to said crankcase chamber and a pressure air conduit for communicating compressed air to said combustion chamber through a poppet type intake valve reciprocally supported in said cylinder head, a valve actuating mechanism contained within said cylinder head for effecting opening and closing of said poppet type intake valve and driven in timed relationship to said crankshaft, a first lubricating system for delivering lubricant from a first lubricant reservoir to said cylinder head for lubricating said valve actuating mechanism, return means for returning lubricant from said engine to said first lubricant reservoir, said first lubricant reservoir containing a first type of lubricant for lubricating said engine, a second lubricant reservoir, means for delivering lubricant from said second lubricant reservoir to said engine through said crankcase chamber for lubricating components contained therein, said second lubricant reservoir containing a lubricant different from the lubricant contained in said first lubricant reservoir.

2. An internal combustion engine as defined in claim 1, further including a timing drive for driving the valve actuating mechanism from the crankshaft and further including a lubricant path for the lubricant from the first lubricant reservoir to lubricate said timing drive.

3. An internal combustion engine as defined in claim 2, further including a lubricant accumulating area contiguous to the crankshaft and spaced from the crankcase chamber in which the lubricant from the first lubricant reservoir may accumulate and drain back to the first lubricant reservoir.

4. An internal combustion engine as defined in claim 1, further including a pressure pump for pumping lubricant from the second lubricant reservoir to the engine and generating pressure greater than the pressure within the crankcase chamber.

5. An internal combustion engine as defined in claim 4, further including a drain for draining lubricant from the engine back to the second lubricant reservoir for recycling.

6. An internal combustion engine as defined in claim 5, wherein lubricant from the second lubricant reservoir is supplied to the bearings from the crankshaft for lubricating the bearings.

7. An internal combustion engine as defined in claim 5, wherein lubricant from the second lubricant reservoir is delivered to the area adjacent the piston through an opening in the cylinder bore for lubricating the piston.

8. An internal combustion engine as defined in claim 7, wherein the piston is formed with a first recess for receiving lubricant from the opening in the cylinder bore and wherein the connecting rod is formed with a lubricant groove aligned, during a portion of the stroke of the piston, with the cylinder bore opening for receiving lubricant therefrom, and further means for delivering lubricant from said connecting rod groove to a piston pin that connects the piston to the connecting rod.

9. An internal combustion engine as defined in claim 8, wherein the piston is formed with a second recess disposed diametrically opposite to the first recess and wherein the lubricant from the piston pin is returned to the second recess for lubricating the other side of the piston.

10. An internal combustion engine as defined in claim 7, further including a timing drive for driving the valve operating mechanism from the crankshaft and further including a lubricant path for the lubricant from the first lubricant reservoir to lubricate the timing drive.

11. An internal combustion engine as defined in claim 10, further including a lubricant accumulating area contiguous to the crankshaft and spaced from the crankcase chamber in which the lubricant from the first lubricant reservoir may accumulate and drain back to the first lubricant reservoir.

12. An internal combustion engine as defined in claim 1 wherein the piston is provided with at least one piston ring for sealing engagement with the cylinder bore and lubricant from the first lubricant reservoir is supplied on one side of the area sealed by said piston ring and lubricant from the second lubricant reservoir is supplied on the other side of the area sealed by the piston ring.

13. An internal combustion engine as defined in claim 12, further including a timing drive for driving the valve actuating mechanism from the crankshaft and further including a lubricant path for the lubricant from the first lubricant reservoir to lubricate said timing drive.

14. An internal combustion engine as defined in claim 13, further including a lubricant accumulating area contiguous to the crankshaft and spaced from the crankcase chamber in which the lubricant from the first lubricant reservoir may accumulate and drain back to the first lubricant reservoir.

15. An internal combustion engine as defined in claim 12, further including a pressure pump for pumping lubricant from the second lubricant reservoir to the engine and generating pressure greater than the pressure within the crankcase chamber.

16. An internal combustion engine as defined in claim 15, further including a drain for draining lubricant from the engine back to the second lubricant reservoir for recycling.

17. An internal combustion engine as defined in claim 16, wherein lubricant from the second lubricant reservoir is supplied to the bearings from the crankshaft for lubricating the bearings.

18. An internal combustion engine as defined in claim 16, wherein lubricant from the second lubricant reservoir is delivered to the area adjacent the piston through an opening in the cylinder bore for lubricating the piston.

19. An internal combustion engine as defined in claim 18, wherein the piston is formed with a first recess for receiving lubricant from the opening in the cylinder bore and wherein the connecting rod is formed with a lubricant groove aligned, during a portion of the stroke of the piston, with the cylinder bore opening for receiving lubricant therefrom, and further means for delivering lubricant from said connecting rod groove to a piston pin that connects the piston to the connecting rod.

20. An internal combustion engine as defined in claim 19, wherein the piston is formed with a second recess disposed diametrically opposite to the first recess and wherein the lubricant from the piston pin is returned to the second recess for lubricating the other side of the piston.

21. An internal combustion engine as defined in claim 18, further including a timing drive for driving the valve operating mechanism from the crankshaft and further including a lubricant path for the lubricant from the first lubricant reservoir to lubricate the timing drive.

22. An internal combustion engine as defined in claim 21, further including a lubricant accumulating area contiguous to the crankshaft and spaced from the crankcase chamber in which the lubricant from the first lubricant reservoir may accumulate and drain back to the first lubricant reservoir.

23. A lubricating arrangement for a reciprocating machine having a horizontally disposed cylinder bore, a piston reciprocating in said cylinder bore, a connecting rod connected at one end to said piston by a piston pin, said piston having a first recess formed in the upper side thereof, a lubricant supply port extending through said cylinder and aligned with said piston recess during at least a portion of the stroke of said piston for collecting lubricant for lubricating the area between said piston and said cylinder bore, said connecting rod having a groove in an upper surface thereof aligned with said cylinder lubricant opening for receiving lubricant therein during at least a portion of the stroke of said piston, said connecting rod recess communicating with a passage extending therethrough to said piston pin for lubricating said piston pin.

24. A lubricating arrangement for a reciprocating machine as defined in claim 23, wherein the piston is formed with a second recess disposed diametrically opposite the first recess and wherein the piston has a passage extending from the piston pin to the second recess for draining lubricant form the piston pin to lubricate the area of the piston adjacent said second recess.

* * * * *